US009172149B2

(12) United States Patent
Xing et al.

(10) Patent No.: US 9,172,149 B2
(45) Date of Patent: Oct. 27, 2015

(54) CABLE ASSEMBLY WITH IMPROVED WIRE MANAGEMENT

(71) Applicant: HON HAI PRECISION INDUSTRY CO., LTD., New Taipei (TW)

(72) Inventors: Da-Wei Xing, Kunshan (CN); Zhan-Feng Song, Kunshan (CN); Yuan-Yuan Lin, Kunshan (CN); Jerry Wu, Irvine, CA (US)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 19 days.

(21) Appl. No.: 14/142,716

(22) Filed: Dec. 27, 2013

(65) Prior Publication Data

US 2014/0187093 A1 Jul. 3, 2014

(30) Foreign Application Priority Data

Dec. 27, 2012 (CN) ..... 2012 2 0731860 U

(51) Int. Cl.

| | |
|---|---|
| ***H01R 13/00*** | (2006.01) |
| ***H01R 4/02*** | (2006.01) |
| ***H01R 13/6471*** | (2011.01) |
| ***H01R 9/03*** | (2006.01) |

(52) U.S. Cl.

CPC ..... *H01R 4/023* (2013.01); *H01R 9/035* (2013.01); *H01R 13/6471* (2013.01)

(58) Field of Classification Search

CPC ..... H01R 11/15; H01R 11/14; H01R 11/24; H01R 4/40; H01R 4/44; H01R 11/32; H01R 12/57; H01R 13/2442; H01R 13/514; G06K 7/0021

USPC ..... 439/479, 494, 499, 492, 701, 108

See application file for complete search history.

(56) References Cited

U.S. PATENT DOCUMENTS

| | | | | | |
|---|---|---|---|---|---|
| 3,004,237 | A | * | 10/1961 | Cole et al. | 439/494 |
| 3,550,066 | A | * | 12/1970 | Cootes | 439/494 |
| 4,094,564 | A | * | 6/1978 | Cacolici | 439/456 |
| 4,105,278 | A | * | 8/1978 | Braund et al. | 439/460 |
| 4,718,860 | A | * | 1/1988 | Gobets et al. | 439/447 |
| 4,722,692 | A | * | 2/1988 | Tengler et al. | 439/92 |
| 4,737,117 | A | * | 4/1988 | Lockard | 439/92 |
| 6,065,993 | A | * | 5/2000 | Lai et al. | 439/402 |

(Continued)

FOREIGN PATENT DOCUMENTS

CN 202076527 12/2011

*Primary Examiner* — Abdullah Riyami
*Assistant Examiner* — Vladimir Imas
(74) *Attorney, Agent, or Firm* — Wei Te Chung; Ming Chieh Chang

(57) ABSTRACT

A cable assembly comprises: an insulative housing; a plurality of contacts received into the insulative housing; a spacer assembled to a rear end of the insulative housing; a wire management assembled to a rear end of the spacer, and a cable electrically connected to the rear ends of the plurality of contacts. The wire management defines a plurality of first and second channels formed on top surfaces. Each of second channel defines a rear inlet and two front outlets. The cable comprises several pairs of signal wires received into the corresponding second channels. Each differential pair of signal wires comprises two signal conductors, a grounding conductor and a shielding layer surrounding the two signal conductors and a grounding conductors. Two front ends of the two signal conductors are exposed out of the shielding layer and extending out of the wire management through two outlets.

19 Claims, 6 Drawing Sheets

(56) References Cited

U.S. PATENT DOCUMENTS

| | | | | |
|---|---|---|---|---|
| 6,273,753 | B1 * | 8/2001 | Ko | 439/579 |
| 6,454,605 | B1 * | 9/2002 | Bassler et al. | 439/607.23 |
| 6,832,931 | B1 * | 12/2004 | Wu | 439/499 |
| 6,869,308 | B2 * | 3/2005 | Wu | 439/497 |
| 6,951,477 | B2 * | 10/2005 | Tondreault et al. | 439/497 |
| 6,976,869 | B1 * | 12/2005 | Wu | 439/499 |
| 7,090,534 | B2 * | 8/2006 | Wu et al. | 439/607.41 |
| 7,147,512 | B2 * | 12/2006 | Wu | 439/607.05 |
| 7,255,607 | B1 * | 8/2007 | Wu | 439/660 |
| 7,351,096 | B2 * | 4/2008 | Kondou et al. | 439/497 |
| 7,390,220 | B1 * | 6/2008 | Wu | 439/607.06 |
| 7,435,132 | B1 * | 10/2008 | Fong et al. | 439/497 |
| 7,452,238 | B1 * | 11/2008 | Wu | 439/579 |
| 7,462,071 | B1 * | 12/2008 | Wu | 439/607.05 |
| 7,481,678 | B2 * | 1/2009 | Aekins | 439/620.11 |
| 7,497,724 | B1 * | 3/2009 | Fong et al. | 439/497 |
| 7,534,143 | B1 * | 5/2009 | Tsao et al. | 439/607.41 |
| 7,553,167 | B2 * | 6/2009 | Zhang et al. | 439/74 |
| 7,632,155 | B1 * | 12/2009 | Wu | 439/660 |
| 7,651,379 | B1 * | 1/2010 | Wu | 439/660 |
| 7,670,154 | B2 * | 3/2010 | Yu et al. | 439/98 |
| 7,708,600 | B2 * | 5/2010 | Wu | 439/660 |
| 7,758,374 | B2 | 7/2010 | Yu et al. | |
| 7,794,273 | B2 * | 9/2010 | Xu et al. | 439/555 |
| 7,803,009 | B2 * | 9/2010 | Su et al. | 439/492 |
| 7,819,675 | B2 * | 10/2010 | Ko et al. | 439/98 |
| 7,896,689 | B1 * | 3/2011 | Su et al. | 439/497 |
| 7,955,114 | B2 * | 6/2011 | Wu | 439/352 |
| 8,062,050 | B2 * | 11/2011 | Wu | 439/350 |
| 8,142,224 | B2 * | 3/2012 | Wu | 439/607.27 |
| 8,500,494 | B2 * | 8/2013 | Wu | 439/660 |
| 8,591,259 | B2 * | 11/2013 | Wu | 439/607.27 |
| 8,708,718 | B2 * | 4/2014 | Li et al. | 439/108 |
| 2009/0197467 | A1 * | 8/2009 | Ko et al. | 439/607.28 |
| 2014/0065884 | A1 * | 3/2014 | Wu et al. | 439/626 |

* cited by examiner

CABLE ASSEMBLY WITH IMPROVED WIRE MANAGEMENT

FIELD OF THE INVENTION

The present invention generally relates to a cable assembly, and more particularly to a cable assembly for transmitting high-speed signal.

DESCRIPTION OF PRIOR ART

Usually, cable assembly is widely used in an electronic device for transmitting signal. Thus, wire management is generally used in the cable assembly for arranging a cable when the cable is soldered to corresponding a plurality of contacts. For example, China Pat. No. 202076527U issued to Su et al. on Dec. 14, 2011 discloses a cable connector assembly comprising an insulative housing defining two rows of passageways, a plurality of contacts received into the corresponding passageways, a spacer assembled to a rear end of the insulative housing, a wire management having a plurality of slots and assembled to the rear end of the spacer and a cable electrically connected with the corresponding contacts. The cable comprises a plurality of wires formed therein passing through the corresponding slots and electrically connected with the plurality of contacts.

However, the aforementioned wire management is only used to separate a plurality of wires of the cable. However, inner conductors formed in some wires are not well arranged by the wire management result in low efficiency during a connecting process between the cable and the plurality of contacts.

Hence, an improved cable assembly is desired to overcome the aforementioned disadvantage.

SUMMARY OF THE INVENTION

Accordingly, an object of the present invention is to provide a cable assembly with an improved wire management to improve assembling efficiency of the cable assembly.

In order to achieve the object set forth, a cable assembly comprises an insulative housing defining a plurality of receiving passageways; a plurality of contacts received into the receiving passageways; a spacer assembled to the rear end of the insulative housing and supporting rear ends of the plurality of contacts; a wire management assembled to a rear end of the spacer and defining a plurality of Y-shape channels formed on top and bottom surfaces thereof, each of Y-shape channel defining a main portion and two branch portions located in front of the main portion; and a cable electrically connected to the rear ends of the plurality of contacts and arranged by the wire management. The cable comprises a plurality of differential pairs of signal wires received into the corresponding Y-shape channels, each differential pair of signal wires comprises two signal conductors, a grounding conductor and a shielding layer surrounding the two signal conductors and a grounding conductor, two signal conductors and a grounding conductor have front ends exposed out of the shielding layer, front ends of two signal conductors are arranged in the two branch portions and extending to the corresponding contacts.

Other objects, advantages and novel features of the invention will become more apparent from the following detailed description when taken in conjunction with the accompanying drawings.

DETAILED DESCRIPTION OF PREFERRED EMBODIMENTS

Figure 1:
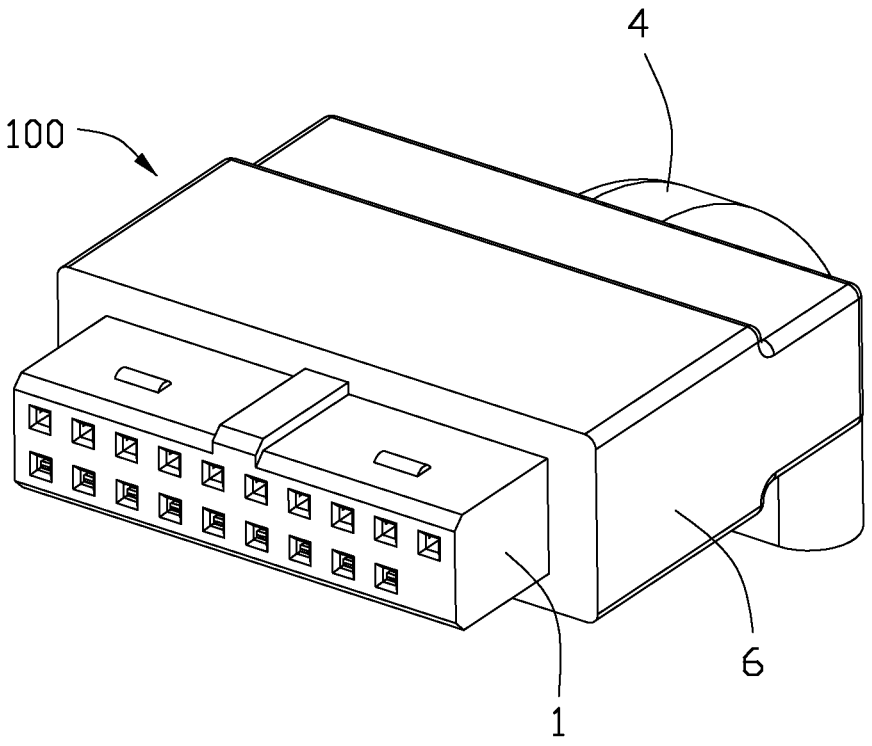
FIG. 1 is an assembled, perspective view of a cable assembly in accordance with the present invention.

Reference will now be made in detail to the preferred embodiment of the present invention.

Referring to FIGS. 1 to 6, a cable assembly 100 in accordance with the present invention comprises an insulative housing 1 defining a plurality of receiving passageways 112, a plurality of contacts 2 accommodated into the receiving passageways 112 of the insulative housing 1, a spacer 3 assembled to a rear end of the insulative housing 1, a cable 5 electrically connected with the contacts 2, a wire management 4 assembled to a rear end of the spacer 3, and a cover 6 overmolding around the rear end of the insulative housing 1, the spacer 3, the wire management 4 and a front portion of the cable 5.

Figure 2:
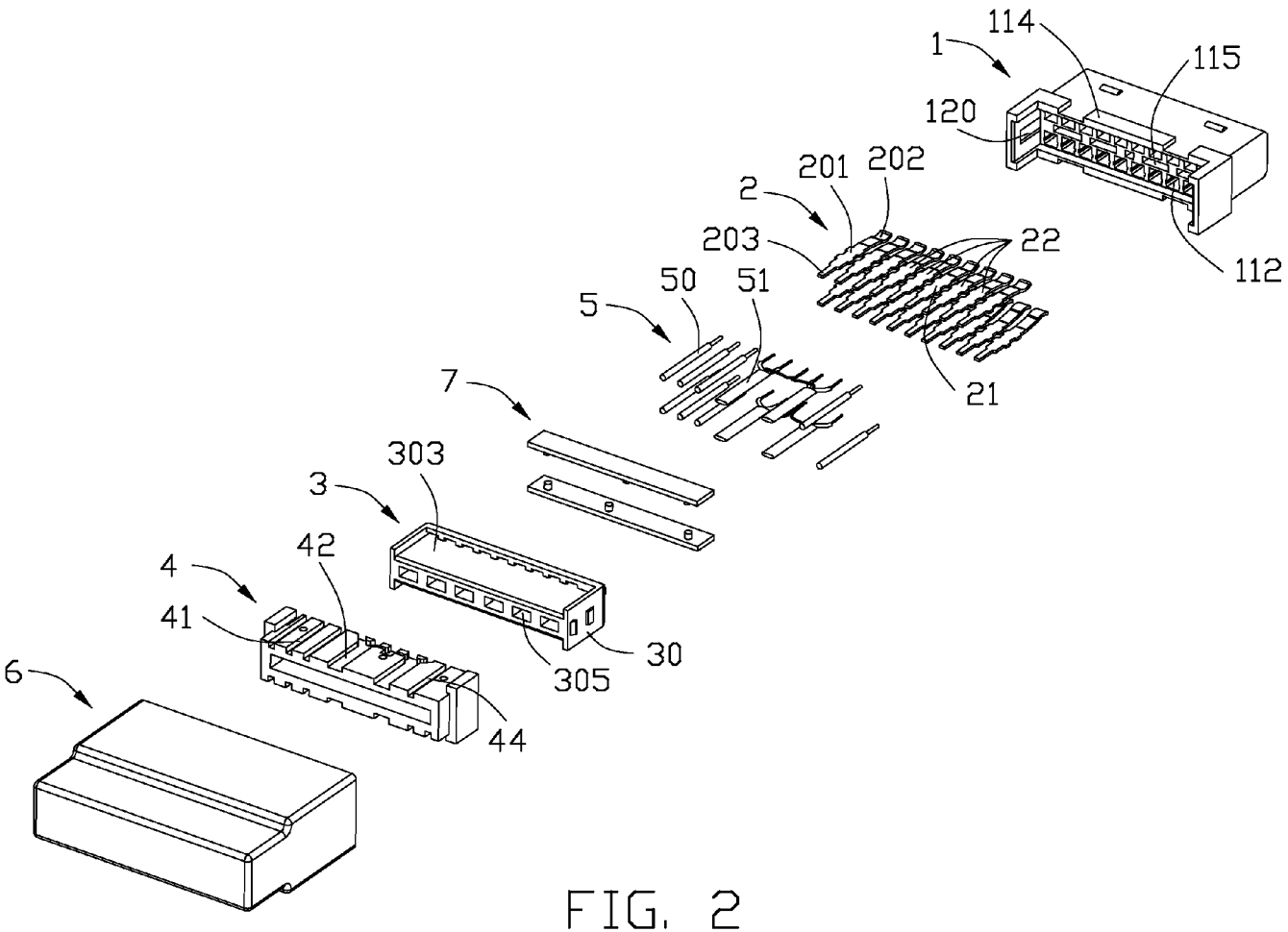
FIG. 2 is an exploded, perspective view of FIG. 1.
Figure 3:
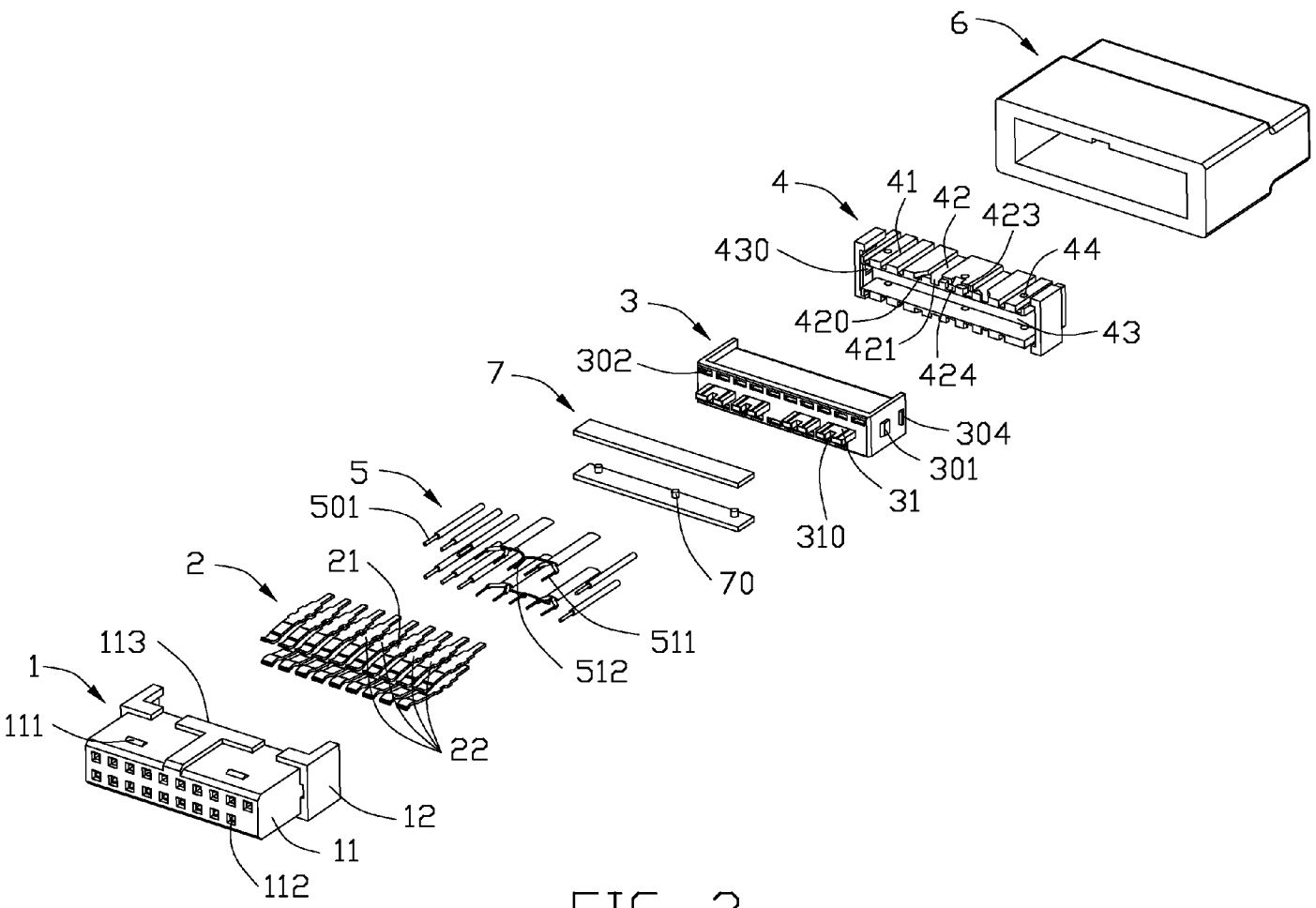
FIG. 3 is similar to the FIG. 2, but view from another aspect.
Figure 4:
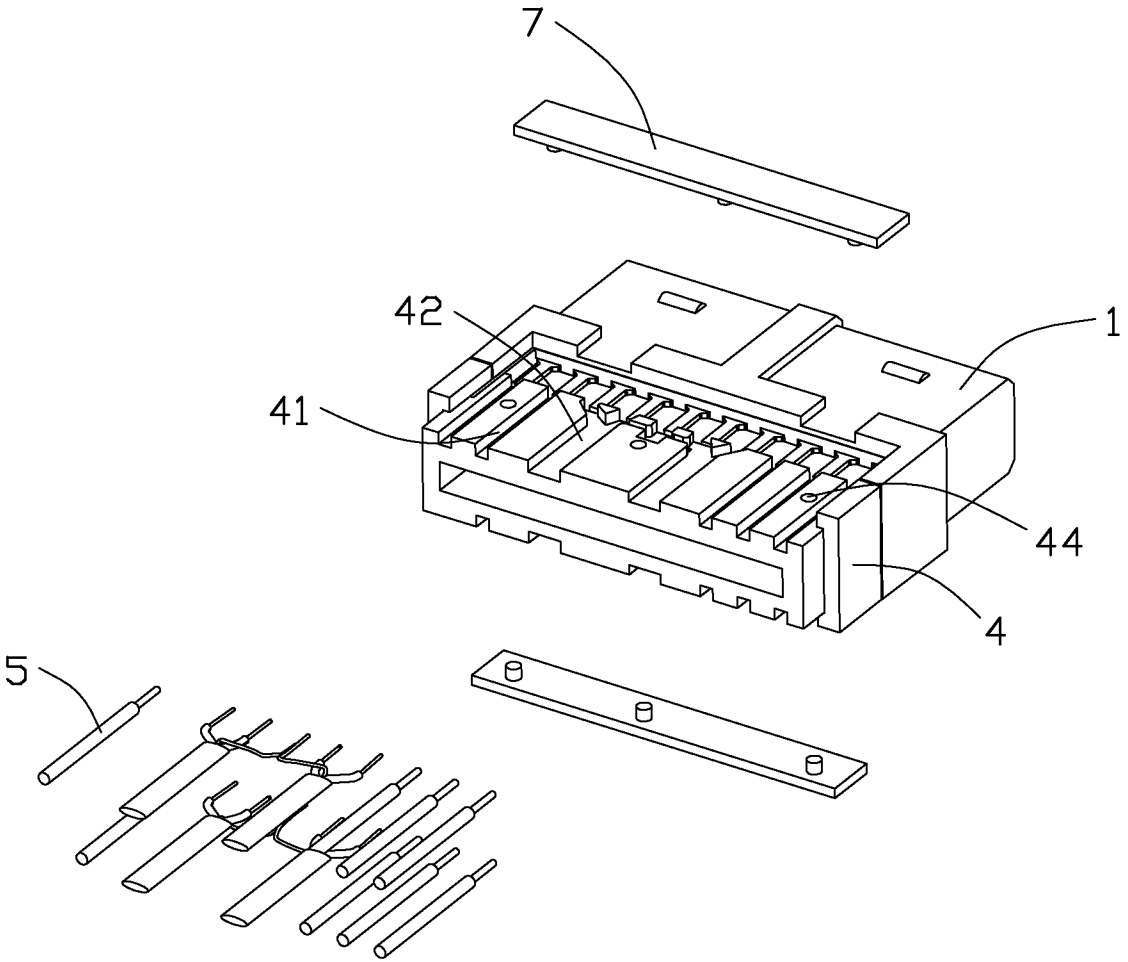
FIG. 4 is a partial assembled, perspective view of the cable assembly without a cover.
Figure 5:
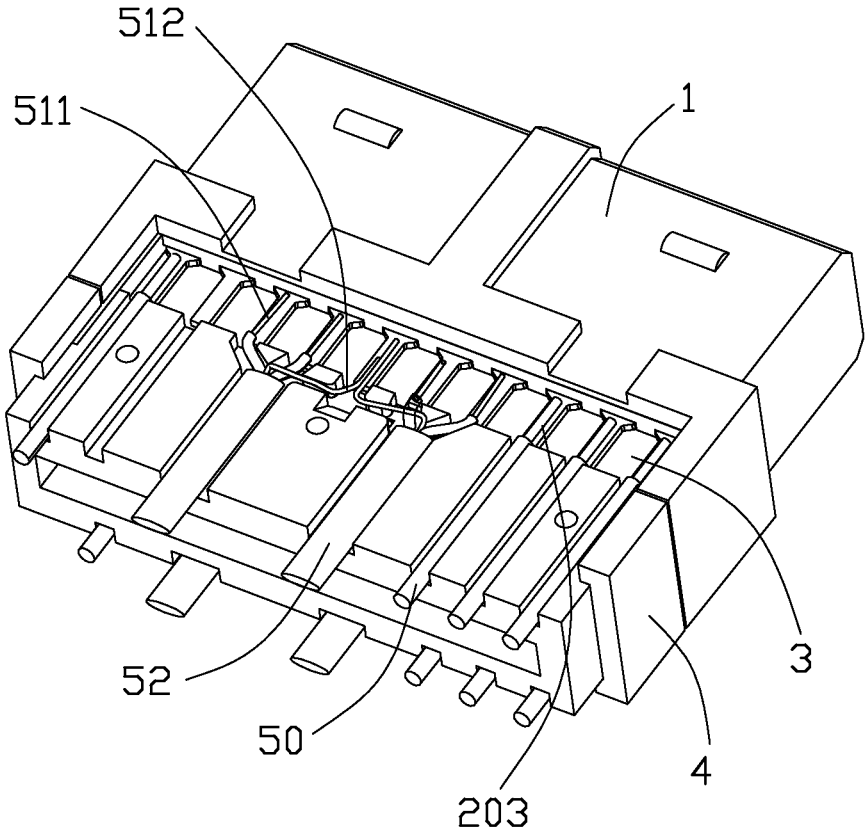
FIG. 5 is an assembled, perspective view of the cable assembly without the cover and two positioning members.
Figure 6:
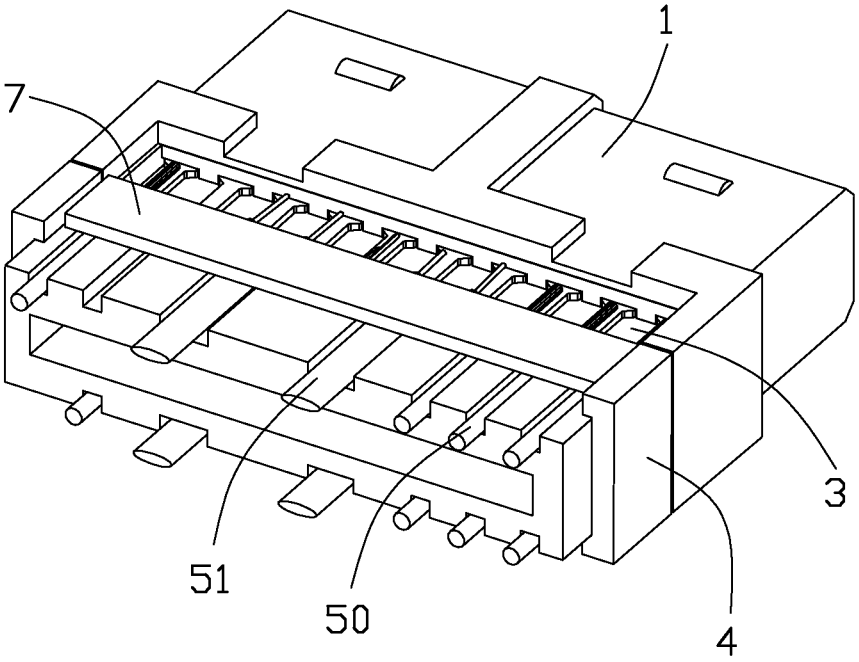
FIG. 6 is an assembled, perspective view of the cable assembly without the cover.

Referring to FIGS. 2 to 3, the insulative housing 1 comprises a body portion 11 and two arm portions 12 respectively extending rearwardly from two lateral sides of the body portion 11. The insulative housing 1 defines a plurality of receiving passageways 112 throughout front and rear faces thereof. The receiving passageways 112 are divided into an upper row and a lower row. The insulative housing 1 further defines a row of blind holes 115 formed on the rear surface of the body portion and located between the two rows of the receiving passageways 112. The body portion 11 defines a T-shaped rib 113 formed on a top surface thereof and a rectangular rib 114 extending along a transversal direction and formed on a bottom surface thereof. The rib 113 is used for anti-mismating with a complementary connector(not shown). Two protrusions 111 are respectively formed on two opposite top and bottom surfaces for engaging with the complementary connector. Each of arm portion 12 defines a sliding slot 120 formed on an inner surface thereof for latching with the spacer 3.

Referring to FIGS. 2 to 3, the plurality of contacts 2 are formed by a stamped process and made of metallic material. The contacts 2 are divided into two rows and received into the receiving passageways 112. Each row of the contacts 2 comprise a plurality of single contacts 21 and two pairs of differential signal contacts 22. There is a single contact 21 which is a grounding contact located between two pairs of differential signal 22. Each contact 2 is structured in a flat shape and comprises a base portion 201, a curved mating portion 202 extending forwardly from a front end of the base portion 201, and a terminating portion 203 extending rearwardly from a rear end of the base portion 201.

Referring to FIGS. 2 to 3, the spacer 3 comprises a base portion 30 and a plurality of positioning posts 31 extending forwardly from the base portion 30. Each of the positioning post 31 has a gap 310 formed on a front end thereof. The base portion 30 defines two depressions 303 respectively formed on top and bottom surfaces thereof. The base portion 30 defines two rows of slots 302 respectively extending from front surface to the two depressions 303. The base portion 30 defines a row of positioning holes 305 depressed forwardly from a rear surface thereof. When the cover 6 is formed through over-molding process, the plastic material of the cover 6 can flow into the positioning holes 305. Thus, the spacer 3 is well positioned with the cover 6. The base portion 30 respectively defines a front latching portion 301 for cooperating with the corresponding sliding slot 120 and a rear latching portions 304 for latching with the wire management 4 on each lateral side thereof.

Referring to FIGS. 2 to 3, the cable 5 comprises a plurality of single wires 50, four pairs of differential signal wires 51 and an insulative jacket (not shown) surrounding the single wires 50 and the signal wires 51. Each of the pair of differential signal wires 51 comprises two signal conductors 511, a grounding conductor 512 and a shielding layer(not numbered) surrounding the two signal conductors 511 and the grounding conductor 512. Front ends of the two signal conductors 511 and a grounding conductor 512 are exposed out of the shielding layer. A distance of the front ends of the signal and grounding conductor 511, 512 exposed out of the shielding layer is controlled below 3 mm to ensure high frequency performance of the cable 5. In the present invention, each pair of differential signal wires 51 is STP(shielded Twisted Pair) wires.

Referring to FIGS. 2 to 5, the wire management 4 defines a plurality of channels 41, 42 respectively formed on top and bottom surfaces thereof. The plurality of channels 42 comprise a plurality of first channels 41 and second channels 42 respectively formed on top and bottom surfaces of the wire management 4. Each of the second channel 42 is structured in a Y-shaped and comprises a main portion and two branch portions 420, 421 located on a front end of the main portion to make the second channel 42 with two outlets. Two adjacent second channels 42 are communicated with each other by a connecting channel 423. The wire management 4 further defines an opening 424 extending rearwardly from a front surface of the wire management 4 and communicated with the connecting channels 423. The connecting channel 423 is communicated with an exterior through an opening 424. The wire management 4 defines a through hole 43 throughout front and rear surfaces thereof. Two indentations 430 are respectively formed on two inner lateral sides of the through hole 43 for cooperating with the second latching portion 304. The wire management 4 defines a plurality of positioning holes 44 respectively formed on top and bottom surfaces thereof. The cable assembly 100 further comprises two positioning members 7 respectively assembled to top and bottom surfaces of the wire management 4. Each of the positioning member 7 defines a plurality of posts 70 received into the plurality of positioning holes 44 of the wire management 4.

Referring to FIGS. 1 to 6, the assembling process of the cable assembly 100 made in according to the present invention starts from assembling a plurality of contacts 2 to the insulating housing 1. The base portions 201 and mating portions 202 of the contacts 2 are received into the receiving passageways 112. And the terminals portions 203 of the contacts 2 are extending out of the receiving passageways 112.

Secondly, the spacer 3 is assembled to a rear end of the insulative housing 1 with the positioning posts 31 received into the blind holes 305 of the insulative housing 1. And two front latching portions 301 of the spacer 3 are respectively inserted into the two sliding slots 120 of the insulative housing 1. Thus, the spacer 3 is engaged with the insulative housing 1. The terminal portions 203 are passed through the slots 302 and extending into the depressions 303.

Thirdly, the wire management 4 is assembled to the rear end of the spacer 3 with the rear latching portion 304 cooperated with the indentation 430. Thus, the wire management 4 is engaged with the spacer 3.

Fourthly, the single wires 50 are arranged in the first channels 41 and the pairs of differential signal wires 51 are arranged in the second channels 42. The two signal conductors 511 of a pair of differential signal wires 51 are respectively arranged in two branch portions 420, 421 and electrically connected with two corresponding signal contacts 22. The grounding conductor 512 of the a pair of differential signal wire 51 is arranged in the connecting channel 423. Front portions of the grounding conductors 512 of two pairs of differential signal wires 51 extend out of the wire management through the opening 424 and electrically connected with a same grounding contact 21.

Fifthly, two positioning members 7 are assembled to the wire management 4. Three posts 70 are received into the three holes 44 of the wire management 4 to achieve an engagement therebetween. The single wires 50 and the pairs of differential signal wires 51 are well positioned on the wire management 4 by the two positioning members 7.

Finally, a cover 6 is formed around the rear end of the insulative housing 1, the spacer 3, the wire management 4 and a front portion of the cable 5 through overmolding process. The plastic material of the cover 6 is flow into the through holes 43 and positioning holes 305. Thus, the spacer 3 and the wire management 4 are well positioned with the cover 6.

After the above assembling steps, the entire process of assembling the cable assembly 100 is finished. The front end of two signal conductors 511 exposed out of the shielding layer are respectively arranged in the branch portions 420, 421 of the second channel 42. And, front ends of the grounding conductors 512 of two pairs of differential signal wires 51 are both arranged by the connecting channel 423 and the opening 424 and extending out of the wire management. Thus, a connecting process between the conductors 511, 512 and the contacts is easily and efficiency. In brief, the instant invention is to provide the wire management with the channel having a split front end region to not only receive the exposed insulators of the differential pair wire but also align the exposed inner conductors with the corresponding contact tail sections for easy soldering thereto.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. A cable assembly comprising:

an insulative housing defining a plurality of receiving passageways;

a plurality of contacts received into the receiving passageways;

a spacer assembled to the rear end of the insulative housing and supporting rear ends of the plurality of contacts;

a wire management assembled to a rear end of the spacer and defining a plurality of Y-shaped channels formed on top and bottom surfaces thereof, each of Y-shaped channel defining a main portion and two branch portions located in front of the main portion; and a cable electrically connected to the rear ends of the plurality of contacts and arranged by the wire management; wherein the cable comprises a plurality of differential pairs of signal wires received into the corresponding Y-shape channels, each differential pair of signal wires comprises two signal conductors, a grounding conductor and a shielding layer surrounding the two signal conductors and a grounding conductor, two signal conductors and a grounding conductor have front ends exposed out of the shielding layer, front ends of two signal conductors are arranged in the two branch portions and extending to the corresponding contacts.

2. The cable assembly as recited in claim 1, wherein the wire management defines a connecting channel connecting with two branch portions of two adjacent Y-shape channels and an opening communicated with the connecting channel along a front-to-rear direction, front ends of two grounding conductors of two differential pair of signal wires are arranged in the connecting channel and extending out of the wire management through the opening.

3. The cable assembly as recited in claim 1, wherein the plurality of contacts comprise a plurality of pairs of differential signal contacts and a plurality of grounding contacts, two signal conductors of each pair of signal wires are electrically connected with the corresponding pair of differential signal contacts, two grounding conductors of two adjacent signal wires are electrically connected to a same grounding contact.

4. The cable assembly as recited in claim 1, wherein the wire management further defines a plurality of rectangular channels formed on top and bottom surfaces, the cable further comprise a plurality of single wires received into the corresponding rectangular channels.

5. The cable assembly as recited in claim 4, further comprising two positioning members respectively assembled to top and bottom surfaces of the wire management to position the plurality of differential signal wires and single wires in the wire management.

6. The cable assembly as recited in claim 5, further comprising a cover is formed around the rear end of the insulative housing, the spacer, the wire management and a front portion of the cable through over-molding process.

7. The cable assembly as recited in claim 1, wherein the spacer defines a front latching portion and a rear latching portion formed on each side surface thereof to respectively engage with the insulative housing and the wire management.

8. The cable assembly as recited in claim 1, wherein the insulative housing has a plurality of blind holes formed on a rear surface thereof, the spacer defines a plurality of mounting arms extending forwardly and accommodated into the blind holes.

9. A cable assembly comprising:

an insulative housing;

a plurality of contacts received into the insulative housing;

a spacer assembled to a rear end of the insulative housing to support rear ends of the plurality of contacts;

a wire management assembled to a rear end of the spacer, the wire management defining a plurality of first and second channels formed on top surfaces thereof, each of second channel defining a rear inlet and two front outlets; and a cable electrically connected to the rear ends of the plurality of contacts; wherein the cable comprises a plurality of differential pairs of signal wires received into the corresponding second channels, each differential pair of signal wires comprises two signal conductors, a grounding conductor and a shielding layer surrounding the two signal conductors and a grounding conductor, two front ends of the two signal conductors are exposed out of the shielding layer and extending out of the wire management through two outlets; wherein the wire management defines a connecting channel communicated with two adjacent second channels along a transversal direction and an opening communicated with the connecting channel along a front-to-rear direction, two front ends of two grounding conductor of two differential pair of signal wires are arranged in the connecting channel and extending out of the wire management through the opening.

10. The cable assembly as recited in claim 9, wherein the cable further comprises a plurality of single wires received into the corresponding first channels.

11. The cable assembly as recited in claim 10, wherein the cable assembly further comprises a positioning member assembled to the wire management to sandwich the differential pairs of signal wires and single wires therebetween.

12. The cable assembly as recited in claim 11, further comprising a cover is formed around the rear end of the insulative housing, the spacer, the wire management and a front portion of the cable through over-molding process.

13. A cable connector assembly comprising:

an insulative housing defining a plurality of passageways;

a plurality of contacts disposed in the corresponding passageways, respectively, each of said contacts defining a front mating section and a rear tail section in a front-to-back direction;

a wire management located behind the housing and defining a plurality of channels extending therethrough in said front-to-back direction and exposed to an exterior in a vertical direction perpendicular to said front-to-back direction for wire loading;

a plurality of differential pair wires located behind the housing, each of said differential pair wires defining a jacket enclosing a braiding, the braiding enclosing one positive signal wire and one negative signal wire and a grounding conductor, each of said signal wires including an inner conductor enclosed by an insulator, in each of said differential pair wires a front end portion of the jacket and the corresponding braiding being removed with a first distance to expose the pair of signal wires and the grounding conductor, in each of said positive signal and negative signal wires a front end section of the insulator being removed with a second distance to expose the corresponding inner conductor; and a front end region of each of said channels being split into two paths in a transverse direction perpendicular to both said front-to-back direction and said vertical direction; wherein each of said differential pair wires is received in the corresponding channels with the exposed insulators of said positive signal wire and said negative signal wire received in the corresponding paths, respectively, so as to have the corresponding exposed inner conductors of said positive signal wire and said negative wire aligned with and soldered upon the tail sections of the corresponding contacts, respectively.

14. The cable connector assembly as claimed in claim 13, wherein a length of the path is similar to that of the exposed insulator of the corresponding positive signal wire or negative signal wire.

15. The cable connector assembly as claimed in claim 13, wherein each of said channel includes a block at a front end region to form said two paths.

16. The cable connector assembly as claimed in claim 13, wherein each of said channel further defines a transverse bypass around the front end region to allow the grounding conductor to extend therealong to be further aligned with the rear tail section of the corresponding contact.

17. The cable connector assembly as claimed in claim 16, wherein the bypasses of the two neighboring channels is joined together to have the grounding conductors of said two neighboring differential pair wires aligned and soldered to the rear tail section of the common contact.

18. The cable connector assembly as claimed in claim 13, further including a positioning member to be attached to the wire management to cover said channels in the vertical direction.

19. The cable connector assembly as claimed in claim 13, further including a spacer between the housing and the wire management in the front-to-back direction, wherein the rear tail sections of the contacts extend to be further supportably exposed on the spacer in the vertical direction to soldering to the corresponding conductors, respectively.

* * * * *